US010394147B2

(12) United States Patent
Yamauchi et al.

(10) Patent No.: US 10,394,147 B2
(45) **Date of Patent: *Aug. 27, 2019**

(54) ELECTROSTATIC LATENT IMAGE DEVELOPING TONER

(71) Applicant: KYOCERA Document Solutions Inc., Osaka (JP)

(72) Inventors: Kohei Yamauchi, Osaka (JP); Toshiki Takemori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,397

(22) Filed: May 25, 2018

(65) Prior Publication Data

US 2018/0348655 A1 Dec. 6, 2018

(30) Foreign Application Priority Data

May 31, 2017 (JP) ..... 2017-107387

(51) Int. Cl.
*G03G 9/087* (2006.01)
*G03G 9/08* (2006.01)

(52) U.S. Cl.
CPC ..... *G03G 9/08755* (2013.01); *G03G 9/0819* (2013.01); *G03G 9/08711* (2013.01); *G03G 9/08728* (2013.01); *G03G 9/08782* (2013.01); *G03G 9/08795* (2013.01); *G03G 9/08797* (2013.01)

(58) Field of Classification Search
CPC ..... G03G 9/08755; G03G 9/08711; G03G 9/08782
See application file for complete search history.

(56) References Cited

U.S. PATENT DOCUMENTS 10,241,431 B2 * 3/2019 Yamauchi ..... G03G 9/0819

FOREIGN PATENT DOCUMENTS

JP 2015-004722 A 1/2015

* cited by examiner

*Primary Examiner* — Peter L Vajda
(74) *Attorney, Agent, or Firm* — Studebaker & Brackett PC

(57) ABSTRACT

Toner particles of a toner contain a non-crystalline polyester resin, a crystalline polyester resin, a styrene-acrylic acid-based resin, and an ester wax. The crystalline polyester resin has a repeating unit derived from an acrylic acid-based monomer and a repeating unit derived from a styrene-based monomer. The styrene-acrylic acid-based resin has a repeating unit derived from an acrylic acid-based monomer having an amino group and a repeating unit derived from a styrene-based monomer. An amino group ratio in the styrene-acrylic acid-based resin is at least 40% and no greater than 60%. The toner has a storage elastic modulus of at least $1.00\times10^5$ Pa and no greater than $5.00\times10^5$ Pa at 90° C. The ester wax has a melting point of at least 60° C. and no higher than 80° C. A dispersion diameter of the ester wax in the toner particles is at least 500 nm and no greater than 1,000 nm.

9 Claims, 2 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2017-107387, filed on May 31, 2017. The contents of this application are incorporated herein by reference in their entirety.

BACKGROUND

The present disclosure relates to an electrostatic latent image developing toner.

There is a known technique for causing toner particles to contain a non-crystalline polyester resin, a crystalline polyester resin, and a styrene-acrylic acid-based resin.

SUMMARY

An electrostatic latent image developing toner according to the present disclosure includes a plurality of toner particles containing a non-crystalline polyester resin and an ester wax. The toner particles further contain a crystalline polyester resin and a styrene-acrylic acid-based resin. The crystalline polyester resin has a first repeating unit derived from an acrylic acid-based monomer and a second repeating unit derived from a styrene-based monomer. The styrene-acrylic acid-based resin has a third repeating unit derived from an acrylic acid-based monomer having an amino group and a fourth repeating unit derived from a styrene-based monomer. In an FT-IR spectrum of the styrene-acrylic acid-based resin measured by an ATR method, an intensity of a peak derived from an amino group included in the third repeating unit is at least 40% and no greater than 60% of an intensity of a peak derived from an aromatic ring included in the fourth repeating unit. The toner has a storage elastic modulus of at least $1.00\times10^5$ Pa and no greater than $5.00\times10^5$ Pa at a temperature of 90° C. The ester wax has a melting point of at least 60° C. and no higher than 80° C. A dispersion diameter of the ester wax in the toner particles is at least 500 nm and no greater than 1,000 nm.

DETAILED DESCRIPTION

Figure 1:
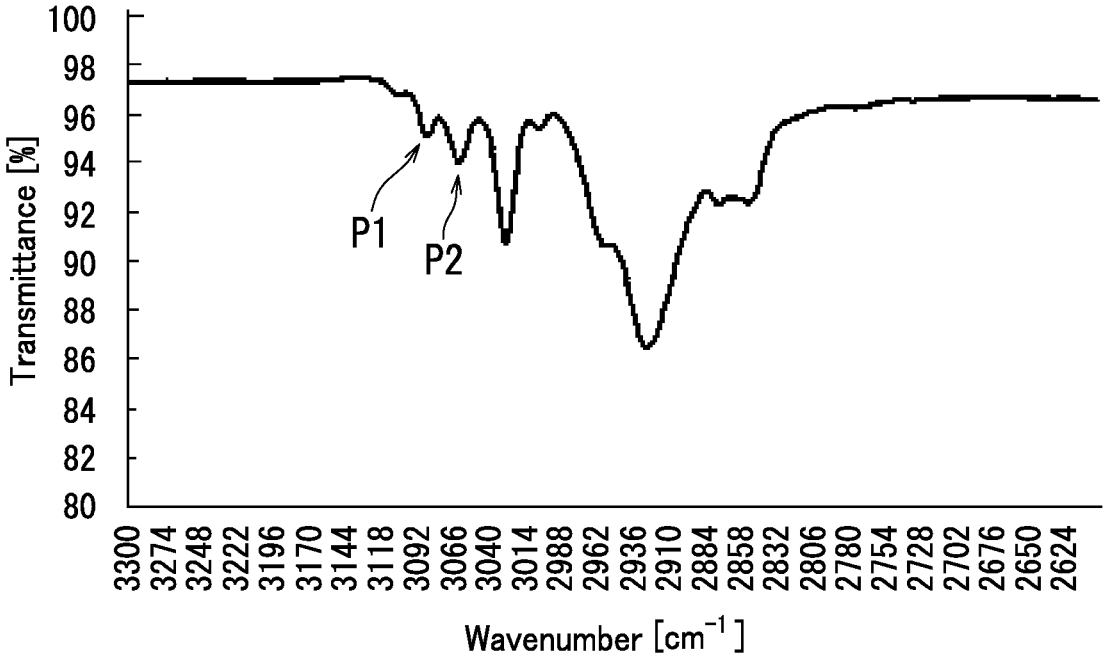
FIG. 1 is a spectral chart showing an FT-IR spectrum measured for a toner according to an embodiment of the present disclosure.

The following describes an embodiment of the present disclosure. Note that evaluation results (values indicating shape, physical properties, and the like) for a powder (specific examples include toner mother particles, an external additive, and a toner) are each a number average of values measured for an appropriate number of particles included in the powder, unless otherwise stated.

A number average particle diameter of a powder is a number average value of equivalent circle diameters of primary particles (Heywood diameters: diameters of circles having the same areas as projections of particles) measured using a microscope, unless otherwise stated. A measured value for the volume median diameter ($D_{50}$) of a powder is a value measured using a laser diffraction/scattering particle size distribution analyzer ("LA-750" manufactured by Horiba, Ltd.), unless otherwise stated. Measured values for the acid value and the hydroxyl value are values measured in accordance with "Japanese Industrial Standard (JIS) K0070-1992", unless otherwise stated. Measured values for the number average molecular weight (Mn) and the mass average molecular weight (Mw) are values measured by gel permeation chromatography, unless otherwise stated.

A value for the glass transition point (Tg) is measured in accordance with "Japanese Industrial Standard (JIS) K7121-2012" using a differential scanning calorimeter ("DSC-6220" manufactured by Seiko Instruments Inc.), unless otherwise stated. On a heat absorption curve (vertical axis: heat flow (DSC signal), horizontal axis: temperature) plotted in a second temperature increase using the differential scanning calorimeter, a temperature (onset temperature) at a point of change in specific heat (an intersection point between an extrapolation of a base line and an extrapolation of an inclined portion of the curve) corresponds to the glass transition point (Tg). A value for the softening point (Tm) is measured using a capillary rheometer ("CFT-500D" manufactured by Shimadzu Corporation), unless otherwise stated. On an S-shaped curve (horizontal axis: temperature, vertical axis: stroke) plotted using the capillary rheometer, a temperature at which the stroke value is "(base line stroke value+maximum stroke value)/2" corresponds to the softening point (Tm). A measured value for the melting point (Mp) is a value read from a heat absorption curve (vertical axis: heat flow (DSC signal), horizontal axis: temperature) plotted using a differential scanning calorimeter ("DSC-6220" manufactured by Seiko Instruments Inc.), unless otherwise stated. A temperature at a heat absorption peak (i.e., a temperature at which endotherm quantity is maximum) on the heat absorption curve corresponds to the melting point (Mp).

Chargeability refers to chargeability in triboelectric charging, unless otherwise stated. Strength of positive chargeability (or strength of negative chargeability) in triboelectric charging can be confirmed using a known triboelectric series or the like.

An SP value (solubility parameter) is a value (unit: $(cal/cm^3)^{1/2}$, temperature: 25° C.) calculated in accordance with the Fedors method (R F. Fedors, "Polymer Engineering and Science", 1974, vol. 14, No. 2, pp. 147-154), unless otherwise stated. The SP value is represented by the following equation "SP value=$(E/V)^{1/2}$" (E: molecular cohesive energy [cal/mol], V: molecular volume [$cm^3$/mol]).

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth) acrylonitrile" is used as a generic term for both acrylonitrile and methacrylonitrile.

A toner according to the present embodiment can be suitably used for development of electrostatic latent images for example as a positively chargeable toner. The toner of the present embodiment is a powder including a plurality of toner particles (particles each having features described later). The toner may be used as a one-component developer. Alternatively, the toner may be mixed with a carrier using a mixer (for example, a ball mill) to prepare a two-component developer. In order to form high quality images, a ferrite carrier (specifically, a powder of ferrite particles) is preferably used as the carrier. In order to form high quality images for an extended period of time, magnetic carrier particles each including a carrier core and a resin layer covering the carrier core are preferably used. In order that carrier particles are magnetic, carrier cores thereof may be formed from a magnetic material (for example, a ferromagnetic material such as ferrite) or a resin in which magnetic particle are dispersed. Magnetic particles may be dispersed in resin layers covering the carrier cores. In order to form high quality images, the amount of the toner in the two-component developer is preferably at least 5 parts by mass and no greater than 15 parts by mass relative to 100 parts by mass of the carrier. Note that a positively chargeable toner included in a two-component developer is positively charged by friction against a carrier.

The toner according to the present embodiment can be used for image formation for example in an electrophotographic apparatus (image forming apparatus). The following describes an example of image forming methods performed using an electrophotographic apparatus.

First, an image forming section (a charger and a light exposure device) of the electrophotographic apparatus forms an electrostatic latent image on a photosensitive member (for example on a surface of a photosensitive drum) based on image data. Subsequently, a developing device (specifically, a developing device loaded with developer including toner) of the electrophotographic apparatus supplies the toner to the photosensitive member to develop the electrostatic latent image formed on the photosensitive member. The toner is charged by friction against a carrier, a development sleeve, or a blade within the developing device before being supplied to the photosensitive member. For example, a positively chargeable toner is positively charged. In a development process, toner (specifically, charged toner) on the development sleeve (for example, a surface of a development roller within the developing device) disposed in the vicinity of the photosensitive member is supplied to the photosensitive member. The supplied toner adheres to a part of the electrostatic latent image on the photosensitive member exposed to light. Through the above, a toner image is formed on the photosensitive member. Toner in an amount corresponding to that consumed in the development process is supplied to the developing device from a toner container accommodating the toner for replenishment use.

In a subsequent transfer process, a transfer device of the electrophotographic apparatus transfers the toner image on the photosensitive member onto an intermediate transfer member (for example, a transfer belt) and further transfers the toner image on the intermediate transfer member onto a recording medium (for example, paper). Thereafter, a fixing device (fixing method: nip fixing using a heating roller and a pressure roller) of the electrophotographic apparatus fixes the toner to the recording medium by applying heat and pressure to the toner. Through the above, an image is formed on the recording medium. For example, a full-color image can be formed by superimposing toner images in respective four colors of black, yellow, magenta, and cyan. After the transfer process, toner remaining on the photosensitive member is removed by a cleaning member (for example a cleaning blade). Note that it is possible to employ a direct transfer process by which the toner image on the photosensitive member is transferred directly onto the recording medium not via the intermediate transfer member. Also, belt fixing may be employed as a fixing method.

The toner according to the present embodiment includes a plurality of toner particles. The toner particles may include an external additive. In a configuration in which the toner particles include an external additive, the toner particles each include a toner mother particle and the external additive. The external additive adheres to a surface of the toner mother particle. The toner mother particle contains a binder resin. The toner mother particle may contain an internal additive (for example, at least one of a releasing agent, a colorant, a charge control agent, and a magnetic powder) in addition to the binder resin as necessary. The external additive may be omitted when unnecessary. When the external additive is omitted, the toner mother particle is equivalent to the toner particle.

The toner particles included in the toner according to the present embodiment may be toner particles each including no shell layer (hereinafter referred to as non-capsule toner particles) or toner particles each including a shell layer (hereinafter referred to as capsule toner particles). Toner mother particles of the capsule toner particles each include a toner core and a shell layer formed on a surface of the toner core. The shell layer is substantially formed from a resin. In a configuration in which toner cores that melt at low temperature are each covered by a shell layer excellent in heat resistance, a resultant toner can have both heat-resistant preservability and low-temperature fixability. An additive may be dispersed in the resin forming the shell layer. The shell layer may cover the entirety or part of the surface of the toner core. The shell layer may be substantially formed from a thermosetting resin or a thermoplastic resin. Alternatively, the shell layer may contain both a thermoplastic resin and a thermosetting resin.

The non-capsule toner particles can be produced for example by a pulverization method or an aggregation method. Through either of these methods, an internal additive can be easily and favorably dispersed in a binder resin of the non-capsule toner particles. Typically, toners are roughly categorized into pulverized toners and polymerized toners (also called chemical toners). A toner produced by the pulverization method belongs to the pulverized toners and a toner produced by the aggregation method belongs to the polymerized toners.

In an example of the pulverization method, a binder resin, a colorant, a charge control agent, and a releasing agent are mixed together initially. Subsequently, the resultant mixture is melt-kneaded using a melt-kneading device (for example a single-screw or twin-screw extruder). The resultant melt-kneaded product is then pulverized and the resultant pulverized product is classified. Through the above, toner mother particles are obtained. Usually, toner mother particles can be produced more easily by the pulverization method than by the aggregation method.

In an example of the aggregation method, a binder resin, a releasing agent, a charge control agent, and a colorant each in the form of fine particles are caused to aggregate in an aqueous medium containing the fine particles until aggregated particles having a desired particle diameter are formed. Through the above, aggregated particles containing the binder resin, the releasing agent, the charge control agent, and the colorant are formed. Subsequently, the aggregated particles are heated to coalesce components contained in the aggregated particles. Through the above, toner mother particles having a desired particle diameter are obtained.

In production of the capsule toner particles, the shell layers may be formed by any process. For example, the shell layers may be formed by any of an in-situ polymerization process, an in-liquid curing film coating process, and a coacervation process.

The toner according to the present embodiment is an electrostatic latent image developing toner having the following features (hereinafter referred to as basic features).

(Basic Features of Toner)

The toner includes a plurality of toner particles containing a non-crystalline polyester resin and an ester wax. The toner particles further contain a crystalline polyester resin and a styrene-acrylic acid-based resin. The crystalline polyester resin has a first repeating unit derived from an acrylic acid-based monomer and a second repeating unit derived from a styrene-based monomer. The styrene-acrylic acid-based resin has a third repeating unit derived from an acrylic acid-based monomer having an amino group and a fourth repeating unit derived from a styrene-based monomer. In an FT-IR spectrum of the styrene-acrylic acid-based resin measured by the ATR method, an intensity of a peak (peak height) derived from an amino group included in the third repeating unit is at least 40% and no greater than 60% of an intensity of a peak (peak height) derived from an aromatic ring included in the fourth repeating unit. The ester wax has a melting point of at least 60° C. and no higher than 80° C. A dispersion diameter of the ester wax in the toner particles is at least 500 nm and no greater than 1,000 nm. A storage elastic modulus of the toner at a temperature of 90° C. (hereinafter referred to as a storage elastic modulus $G'_{90}$) is at least $1.00\times10^5$ Pa and no greater than $5.00\times10^5$ Pa.

A vinyl compound forms a repeating unit constituting a resin by addition polymerization through carbon-to-carbon double bonding "C═C" ("C═C"→"—C—C—"). A vinyl compound is a compound that has a vinyl group ($CH_2$═CH—) or a substituted vinyl group in which a hydrogen atom is replaced. Examples of vinyl compounds include ethylene, propylene, butadiene, vinyl chloride, acrylic acid, acrylic acid ester, methacrylic acid, methacrylic acid ester, acrylonitrile, and styrene.

The dispersion diameter of the ester wax in the toner particles refers to a number average value of equivalent circle diameters of ester wax domains measured in cross-sectional images of the toner particles.

In the following description, a ratio of an intensity of a peak derived from the amino group included in the third repeating unit to an intensity of a peak derived from the aromatic ring included in the fourth repeating unit as determined from an FT-IR spectrum of the styrene-acrylic acid-based resin measured by the ATR method may be referred to as an amino group ratio. A peak intensity corresponds to a distance from the top point of the peak to a base line. For example, when the transmittance of the base line is 97% and the transmittance of the top point of the peak is 94% in the FT-IR spectrum of the styrene-acrylic acid-based resin, the peak intensity is 3% (=97%−94%). In a configuration in which the intensity of the peak derived from the aromatic ring included in the fourth repeating unit is 3.0%, the above-described requirement of the amino group ratio being at least 40% and no greater than 60% is satisfied when the intensity of the peak derived from the amino group included in the third repeating unit is at least 1.2% and no greater than 1.8%. When there are a plurality of peaks derived from the amino group included in the third repeating unit, the amino group ratio is calculated based on an intensity of a peak having the largest intensity among the plurality of peaks derived from the amino group. When there are a plurality of peaks derived from the aromatic ring included in the fourth repeating unit, the amino group ratio is calculated based on an intensity of a peak having the largest intensity among the plurality of peaks derived from the aromatic ring. Note that the FT-IR spectrum is measured by the same method as that described below in Examples or an alternative method thereof.

FIG. 1 shows an example of an FT-IR spectrum of a toner having the above-described basic features. The FT-IR spectrum (vertical axis: transmittance, horizontal axis: wavenumber) shown in FIG. 1 has a peak P1 derived from the amino group included in the third repeating unit and a peak P2 derived from the aromatic ring included in the fourth repeating unit.

In the following description, a storage elastic modulus temperature dependence curve (vertical axis: storage elastic modulus, horizontal axis: temperature) of a toner obtained through measurement performed using a rheometer under conditions of a heating rate of 2° C./minute and a frequency of 6.28 radian/second will be referred to as a "G' temperature dependence curve". The storage elastic modulus $G'_{90}$ of the toner in the above-described basic features is a value read from the G' temperature dependence curve. Note that the G' temperature dependence curve is obtained through measurement performed by the same method as that described below in Examples or an alternative method thereof.

Figure 2:
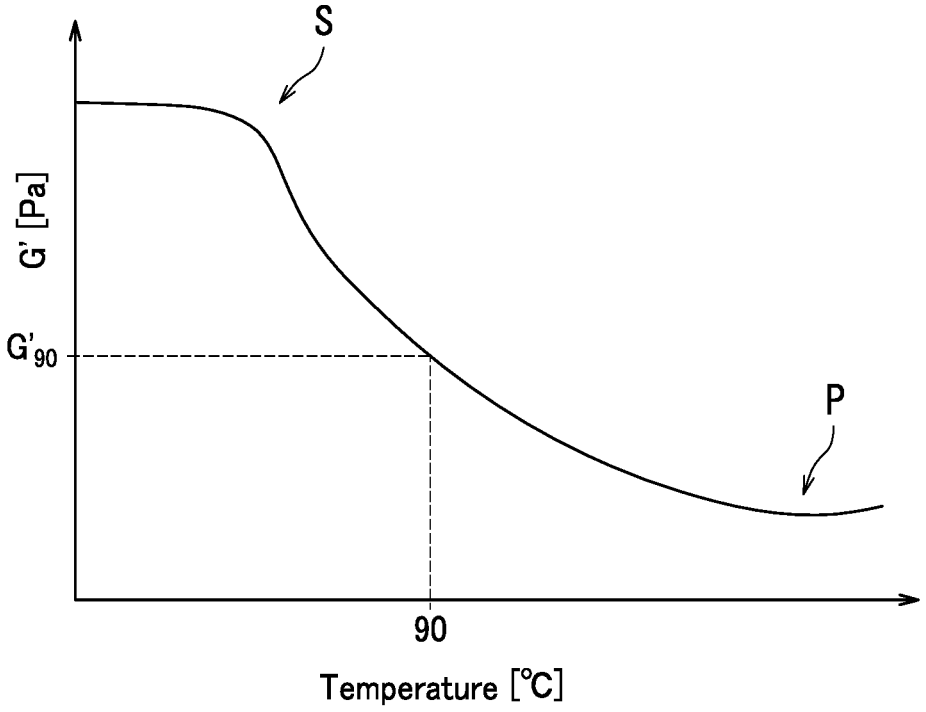
FIG. 2 is a graph showing an example of a G' temperature dependence curve of the toner according to the embodiment of the present disclosure.

FIG. 2 shows an example of a G' temperature dependence curve (vertical axis: storage elastic modulus, horizontal axis: temperature) of a toner having the above-described basic features. FIG. 2 shows temperature dependence of the storage elastic modulus of the toner within a range of from 50° C. to 200° C. Specifically, FIG. 2 shows a result of measurement of the storage elastic modulus of the toner performed by increasing the temperature of the toner from 50° C. at a constant rate (heating rate: 2° C./minute) and measuring storage elastic moduli of the toner at respective temperatures using a rheometer under a condition of a frequency of 6.28 radian/second. In the G' temperature dependence curve shown in FIG. 2, the storage elastic modulus decreases as the temperature of the toner increases. Also, the G' temperature dependence curve has a shoulder part S and a saturation point P. In the following description, a temperature at the saturation point P may be referred to as a "saturation temperature". When the temperature of the toner reaches a temperature at the shoulder part S while being increased from 50° C., the storage elastic modulus of the toner starts to sharply decrease. The storage elastic modulus of the toner continues decreasing at a high rate for a certain period and then the rate of change of the storage elastic modulus gradually decreases. The storage elastic modulus of the toner no longer changes after the saturation point P. The rate of change of the storage elastic modulus of the toner (corresponding to an inclination of the G' temperature dependence curve) sharply changes at the temperature of the shoulder part S. The storage elastic modulus of the toner is substantially constant within a temperature range from the saturation point P (i.e., at temperatures equal to or higher than the saturation temperature). On the G' temperature dependence curve shown in FIG. 2, the temperature at the shoulder part S is 50° C. and the temperature at the saturation point P is 160° C. Note that when it is not possible to determine a definite point (one point) at which the inclination of the G' temperature dependence curve sharply changes, an intersection point between a tangent of a portion of the curve before a sharp change in inclination thereof and a tangent of a portion of the curve after the sharp change in inclination thereof is determined to be a shoulder part.

The toner particles of the toner having the above-described basic features contain the crystalline polyester resin and the non-crystalline polyester resin. The toner particles containing the crystalline polyester resin can have sharp meltability. As a result of the toner particles having sharp meltability, the toner tends to be excellent in both heat-resistant preservability and low-temperature fixability.

However, in a configuration in which the toner particles contain a crystalline polyester resin, the toner tends to have low elasticity. When the toner has low elasticity, hot offset is likely to occur and pulverizability of the toner tends to be impaired. Therefore, it can be considered to improve elasticity of the toner by causing the toner particles to contain a non-crystalline polyester resin having a low softening point (Tm). However, in a configuration in which the toner particles contain a non-crystalline polyester resin having a low softening point (Tm), low-temperature fixability of the toner tends to be impaired.

The toner particles of the toner having the above-described basic features contain the styrene-acrylic acid-based resin in addition to the crystalline polyester resin and the non-crystalline polyester resin. The present inventor found that pulverizability of the toner can be improved by causing the toner particles to contain the crystalline polyester resin, the non-crystalline polyester resin, and the styrene-acrylic acid-based resin. A reason for this is thought to be an increase of pulverization interfaces.

The crystalline polyester resin, the non-crystalline polyester resin, and the styrene-acrylic acid-based resin, which are typically used as toner materials, tend not to be compatible with one another. Therefore, in a situation in which these three types of resins are simply used as a binder resin of toner particles, toner components (internal additives) are likely to be insufficiently dispersed. Insufficient dispersion of the toner components tends to result in impairment of low-temperature fixability of the toner. A binder resin of toner particles typically has an SP value of at least 9 and no greater than 12.

In the toner having the above-described basic features, the crystalline polyester resin has the first repeating unit derived from an acrylic acid-based monomer and the second repeating unit derived from a styrene-based monomer. Also, the styrene-acrylic acid-based resin has the third repeating unit derived from an acrylic acid-based monomer having an amino group and the fourth repeating unit derived from a styrene-based monomer. The amino group ratio in the styrene-acrylic acid-based resin is at least 40% and no greater than 60%. As a result of the crystalline polyester resin and the styrene-acrylic acid-based resin both having styrene-acrylic acid-based units (the crystalline polyester resin: the first repeating unit and the second repeating unit, the styrene-acrylic acid-based resin: the third repeating unit and the fourth repeating unit) and the amino group ratio in the styrene-acrylic acid-based resin being at least 40% and no greater than 60%, respective SP values of the crystalline polyester resin, the non-crystalline polyester resin, and the styrene-acrylic acid-based resin can be made appropriately close to one another. When the crystalline polyester resin, the non-crystalline polyester resin, and the styrene-acrylic acid-based resin are appropriately compatible with one another, pulverizability of the toner can be improved and insufficient dispersion of the toner components (internal additives) can be prevented.

The present inventor found that as a result of the toner particles containing the ester wax as well as the binder resin (the crystalline polyester resin, the non-crystalline polyester resin, and the styrene-acrylic acid-based resin) as defined in the above-described basic features, not only compatibility among the crystalline polyester resin, the non-crystalline polyester resin, and the styrene-acrylic acid-based resin is appropriate but also compatibility between the binder resin and a releasing agent (the ester wax) is appropriate. When the amino group ratio in the styrene-acrylic acid-based resin is at least 40% and no greater than 60%, appropriate difference is made between respective SP values of the binder resin and the ester wax (the releasing agent), resulting in appropriate dispersion of the ester wax (the releasing agent) having an appropriate dispersion diameter in the toner particles. When compatibility between the binder resin and the ester wax is appropriate, the ester wax can have an appropriate dispersion diameter (specifically, at least 500 nm and no greater than 1,000 nm) in the toner particles. In a configuration in which the amino group ratio in the styrene-acrylic acid-based resin is excessively large, compatibility between the binder resin and the ester wax (the releasing agent) is insufficient, with a result that the releasing agent tends to have an excessively large dispersion diameter. When the releasing agent has an excessively large dispersion diameter, the toner tends to agglomerate in storage. In a configuration in which the amino group ratio in the styrene-acrylic acid-based resin is excessively small, the binder resin and the ester wax (the releasing agent) are excessively compatible with each other, with a result that the releasing agent tends to have an excessively small dispersion diameter. When the releasing agent has an excessively small dispersion diameter, hot offset resistance of the toner tends to be insufficient. In the toner having the above-described basic features, the dispersion diameter of the ester wax in the toner particles is at least 500 nm and no greater than 1,000 nm. When the releasing agent (the ester wax) having an appropriate dispersion diameter is dispersed in the toner particles, releasability (consequently, hot offset resistance) of the toner can be improved.

The present inventor further found that gloss (glossiness) of an image can be improved by increasing a bleed out amount of the ester wax bleeding from the toner particles in toner fixing. The present inventor succeeded in attaining a sufficient bleed out amount of the ester wax by making the ester wax contained in the toner particles rapidly melt in toner fixing and increasing the storage elastic modulus $G'_{90}$ of the toner (specifically, the storage elastic modulus of the toner around a fixing temperature). The smaller the storage elastic modulus $G'_{90}$ of the toner is, the lower a tendency of the ester wax to bleed out in toner fixing is. In order to attain a sufficient bleed out amount of the ester wax, it is preferable that the toner has a high storage elastic modulus $G'_{90}$. More specifically, the toner preferably has a storage elastic modulus $G'_{90}$ of at least $1.00\times10^5$ Pa. In a configuration in which the toner particles contain an ester wax having a melting point of no higher than 80° C., the ester wax contained in the toner particles rapidly melts in toner fixing.

The ester wax contained in the toner particles preferably has a melting point of at least 50° C. When the ester wax contained in the toner particles has an excessively low melting point, it is difficult to ensure sufficient heat-resistant preservability of the toner (see a toner TB-7 described below, for example).

The toner preferably has a storage elastic modulus $G'_{90}$ of no greater than $5.00\times10^5$ Pa. When the toner has an excessively high storage elastic modulus $G'_{90}$, it is difficult to ensure sufficient low-temperature fixability of the toner. In a configuration in which the toner particles contain an ester wax having a low melting point together with the crystalline polyester resin, sharp meltability of the non-crystalline polyester resin in toner fixing can be improved. In the toner particles, the crystalline polyester resin and the ester wax having a low melting point each function as a plasticizer for the non-crystalline polyester resin. In a configuration in which the toner particles contain the ester wax having a low melting point, sufficient low-temperature fixability of the toner can be easily achieved.

In order that the toner has both heat-resistant preservability and low-temperature fixability, it is preferable that on the G' temperature dependence curve of the toner, the temperature at the shoulder part S is at least 40° C. and no higher than 60° C. and the temperature at the saturation point P is at least 140° C. and no higher than 180° C.

In the above-described basic features, the toner particles preferably contain at least 10 parts by mass and no greater than 20 parts by mass of the crystalline polyester resin and at least 30 parts by mass and no greater than 50 parts by mass of the styrene-acrylic acid-based resin relative to 100 parts by mass of the non-crystalline polyester resin. In a configuration in which the toner particles contain the respective resins in respective appropriate amounts, pulverizability and low-temperature fixability of the toner can be improved and insufficient dispersion of toner components (internal additives) can be prevented. When the amount of the crystalline polyester resin is excessively small, low-temperature fixability of the toner tends to be impaired. When the amount of the crystalline polyester resin is excessively large, pulverizability of the toner tends to be impaired. When the amount of the styrene-acrylic acid-based resin is excessively small, pulverizability of the toner tends to be impaired. When the amount of the styrene-acrylic acid-based resin is excessively large, the toner components (internal additives) are likely to be insufficiently dispersed. In order to prevent insufficient dispersion of the toner components (internal additives), it is particularly preferable that the non-crystalline polyester resin contained in the toner particles contains an aliphatic diol having a carbon number of at least 2 and no greater than 6 (for example, 1,2-propanediol having a carbon number of 3) as an alcohol component and does not contain a bisphenol.

Also, the amount of the ester wax contained in the toner particles is preferably at least 8 parts by mass and no greater than 15 parts by mass relative to 100 parts by mass of the non-crystalline polyester resin. When the amount of the releasing agent is excessively large or the dispersion diameter of the releasing agent is excessively large, the releasing agent tends to be detached from the toner particles. Detachment of the releasing agent may cause agglomeration of the toner in storage and fogging and contamination of the inside of the apparatus in image formation.

In order to obtain a toner that is excellent in heat-resistant preservability, low-temperature fixability, and hot offset resistance and use of which enables formation of images that are excellent in gloss, it is particularly preferable that the toner particles contain the following non-crystalline polyester resin, crystalline polyester resin, and styrene-acrylic acid-based resin at the above-described mass ratio.

The non-crystalline polyester resin is a polymer of monomers (resin raw materials) including 1,2-propanediol, an aromatic dicarboxylic acid, and a tribasic carboxylic acid. The crystalline polyester resin is a polymer of monomers (resin raw materials) including α,ω-alkanediol, a dibasic carboxylic acid, a styrene-based monomer, and a (meth) acrylic acid alkyl ester. The styrene-acrylic acid-based resin is a polymer of monomers (resin raw materials) including a styrene-based monomer, a (meth)acrylic acid amino alkyl ester, and a cross-linking agent.

The toner particles preferably have a volume median diameter ($D_{50}$) of at least 4 μm and no greater than 9 μm in order that the resultant toner is suitable for image formation.

The following describes a configuration of non-capsule toner particles. Specifically, toner mother particles (a binder resin and internal additives) and an external additive will be described in order. The following toner mother particles of the non-capsule toner particles can be used as toner cores of capsule toner particles.

[Toner Mother Particles]

The toner mother particles contain a binder resin. The toner mother particles may also contain internal additives (for example, a colorant, a releasing agent, a charge control agent, and a magnetic powder).

(Binder Resin)

The binder resin is typically a main component (for example, at least 85% by mass) of the toner mother particles. Therefore, properties of the binder resin are thought to have great influence on overall properties of the toner mother particles. For example, in a configuration in which the binder resin has an ester group, a hydroxyl group, an ether group, an acid group, or a methyl group, the toner mother particles have a strong tendency to be anionic. In a configuration in which the binder resin has an amino group, the toner mother particles have a strong tendency to be cationic.

The toner mother particles of the toner having the above-described basic features contain as the binder resin, the crystalline polyester resin, the non-crystalline polyester resin, and the styrene-acrylic acid-based resin.

A polyester resin can be obtained through condensation polymerization between at least one polyhydric alcohol and at least one polybasic carboxylic acid. Examples of alcohols that can be preferably used for synthesis of a polyester resin include the following dihydric alcohols (specific examples include aliphatic diols and bisphenols) and tri- or higher-hydric alcohols. Examples of carboxylic acids that can be preferably used for synthesis of a polyester resin include the following dibasic carboxylic acids and tri- or higher-basic carboxylic acids.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), unsaturated dicarboxylic acids (specific examples include maleic acid, fumaric acid, citraconic acid, itaconic acid, and glutaconic acid), and cycloalkane dicarboxylic acids (specific examples include cyclohexanedicarboxylic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A styrene-acrylic acid-based resin is a copolymer of at least one styrene-based monomer and at least one acrylic acid-based monomer. Examples of styrene-based monomers and acrylic acid-based monomers that can be preferably used for synthesis of a styrene-acrylic acid-based monomers include the followings.

Examples of preferable styrene-based monomers include styrene, alkylstyrenes (specific examples include α-methylstyrene, p-ethylstyrene, and 4-tert-butylstyrene), p-hydroxystyrene, m-hydroxystyrene, and halogenated styrenes (specific examples include monochlorostyrene, dichlorostyrene, p-bromostyrene, 2,4,5-tribromostyrene, and 2,4,6-tribromostyrene).

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

The non-crystalline polyester resin (the binder resin) is preferably a non-crystalline polyester resin containing 1,2-propanediol as an alcohol component, and particularly preferably a polymer of monomers (resin raw materials) including 1,2-propanediol, at least one aromatic dicarboxylic acid (for example, a terephthalic acid), and at least one tri- or higher-basic carboxylic acid (for example, a trimellitic acid). A tri- or higher-basic carboxylic acid (for example, a trimellitic acid) functions as a cross-linking agent.

It is particularly preferable that the above-described 1,2-propanediol used for synthesis of the non-crystalline polyester resin (the binder resin) is a plant-derived 1,2-propanediol. The plant-derived 1,2-propanediol can be produced for example through chemical synthesis, fermentation, or a combination thereof. In an example of methods for producing the plant-derived 1,2-propanediol, glycerin is obtained through hydrolysis of plant biomass containing a saccharide such as glucose. Subsequently, the resultant glycerin is caused to react with hydrogen. Through the above, the plant-derived 1,2-propanediol is obtained. At least one plant oil selected from the group consisting of soya oil, coconut oil, palm oil, castor oil, and cocoa oil can for example be used as the plant biomass. The plant biomass may be hydrolyzed by a chemical method using an acid or a base, a biological method using an enzyme or a microorganism, or any other method.

In the above-described section "Basic Features of Toner", the crystalline polyester resin has the first repeating unit derived from an acrylic acid-based monomer and the second repeating unit derived from a styrene-based monomer. The crystalline polyester resin (the binder resin) as above is particularly preferably a polymer of monomers (resin raw materials) including at least one a, o-alkanediol (for example, 1,4-butanediol and 1,6-hexanediol), at least one dibasic carboxylic acid (for example, fumaric acid), at least one styrene-based monomer (for example, styrene), and at least one (meth)acrylic acid alkyl ester (for example, n-butyl methacrylate).

In the above-described section "Basic Features of Toner", the styrene-acrylic acid-based resin has the third repeating unit derived from an acrylic acid-based monomer having an amino group and the fourth repeating unit derived from a styrene-based monomer. The styrene-acrylic acid-based resin (the binder resin) as above is preferably a crosslinked styrene-acrylic acid-based resin, and particularly preferably a polymer of monomers (resin raw materials) including at least one styrene-based monomer (for example, styrene), at least one (meth)acrylic acid amino alkyl ester (specific examples include aminoethyl acrylate), and at least one cross-linking agent (for example, divinylbenzene).

(Colorant)

The toner mother particles may contain a colorant. A known pigment or dye that matches the color of the toner can be used as the colorant. In order that the toner is suitable for image formation, the amount of the colorant is preferably at least 1 part by mass and no greater than 20 parts by mass relative to 100 parts by mass of the binder resin.

The toner mother particles may contain a black colorant. An example of the black colorant is carbon black. Alternatively, the black colorant may be a colorant adjusted to black color using a yellow colorant, a magenta colorant, and a cyan colorant.

The toner mother particles may contain a non-black colorant such as a yellow colorant, a magenta colorant, or a cyan colorant.

At least one compound selected from the group consisting of condensed azo compounds, isoindolinone compounds, anthraquinone compounds, azo metal complexes, methine compounds, and arylamide compounds can for example be used as the yellow colorant. Examples of yellow colorants that can be preferably used include C.I. Pigment Yellow (3, 12, 13, 14, 15, 17, 62, 74, 83, 93, 94, 95.97, 109, 110, 111, 120, 127, 128, 129, 147, 151, 154, 155, 168, 174, 175, 176, 180, 181, 191, or 194), Naphthol Yellow S, Hansa Yellow G and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as the cyan colorant. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles of the toner having the above-described basic features contain the ester wax as the releasing agent. The ester wax in the toner particles has a dispersion diameter of at least 500 nm and no greater than 1,000 nm. In order to easily and accurately control releasability of the toner, it is preferable that no releasing agent other than the ester wax is substantially contained in the toner mother particles.

It is particularly preferable that the ester wax is a synthetic ester wax. When the synthetic ester wax is used as the releasing agent, a melting point of the releasing agent can be easily adjusted within a desired range. The synthetic ester wax can be synthesized for example through a reaction between an alcohol and a carboxylic acid (or a carboxylic acid halide) in the presence of an acid catalyst. A substance derived from a natural product, such as a long-chain fatty acid prepared from a natural oil may be used as a raw material for the synthetic ester wax. Alternatively, a commercially available synthetic product may be used as a raw material for the synthetic ester wax.

(Charge Control Agent)

The toner mother particles may contain a charge control agent. The charge control agent is used for example in order to improve charge stability or a charge rise characteristic of the toner. The charge rise characteristic of the toner is an indicator as to whether or not the toner can be charged to a specific level in a short period of time.

Anionic strength of the toner mother particles can be increased by inclusion of a negatively chargeable charge control agent (specific examples include organic metal complexes and chelate compounds) in the toner mother particles. Cationic strength of the toner mother particles can be increased by inclusion of a positively chargeable charge control agent (specific examples include pyridine, nigrosine, and quaternary ammonium salt) in the toner mother particles. However, the toner mother particles need not contain a charge control agent so long as sufficient chargeability of the toner is ensured.

(Magnetic Powder)

The toner mother particles may contain a magnetic powder. Examples of materials of the magnetic powder include ferromagnetic metals (specific examples include iron, cobalt, nickel, and alloys including at least one of these metals), ferromagnetic metal oxides (specific examples include ferrite, magnetite, and chromium dioxide), and materials subjected to ferromagnetization (specific examples include carbon materials to which ferromagnetism is imparted through thermal treatment). A magnetic powder may be used alone or two or more magnetic powders may be used in combination.

[External Additive]

An external additive (specifically, a powder including a plurality of external additive particles) may be attached to surfaces of the toner mother particles. Unlike internal additives, the external additive is not present within the toner mother particles and is selectively present only on the surfaces of the toner mother particles (surfaces of the toner particles). The external additive particles (powder) can be attached to the surfaces of the toner mother particles (powder) for example by stirring the toner mother particles and the external additive together. The toner mother particles and the external additive particles do not chemically react with each other. The toner mother particles and the external additive particles bond together physically rather than chemically. Bonding strength between the toner mother particles and the external additive particles can be adjusted by controlling stirring conditions (specific examples include stirring time and rotational speed of stirring), and particle diameter, shape, surface state, and the like of the external additive particles.

In order to make the external additive exhibit its function while preventing detachment of the external additive particles from the toner particles, the amount of the external additive (when plural types of external additive particles are used, a total amount of the plural types of external additive particles) is preferably at least 0.5 parts by mass and no greater than 10 parts by mass relative to 100 parts by mass of the toner mother particles.

The external additive particles are preferably inorganic particles, and particularly preferably silica particles or particles of a metal oxide (specific examples include alumina, titanium oxide, magnesium oxide, zinc oxide, strontium titanate, and barium titanate). In order to improve fluidity of the toner, inorganic particles (powder) having a number average primary particle diameter of at least 5 nm and no greater than 30 nm are preferably used as the external additive particles. However, particles of an organic acid compound such as a fatty acid metal salt (specific examples include zinc stearate) or resin particles may be used as the external additive particles. Alternatively, composite particles formed from a plurality of materials may be used as external additive particles. One type of external additive particles may be used alone or plural types of external additive particles may be used in combination.

Surface treatment may be performed on the external additive particles. For example, when silica particles are used as the external additive particles, hydrophobicity and/or positive chargeability may be imparted to surfaces of the silica particles through use of a surface treatment agent. Examples of surface treatment agents that can be preferably used include coupling agents (specific examples include silane coupling agent, titanate coupling agent, and aluminate coupling agent), silazane compounds (specific examples include chain silazane compounds and cyclic silazane compounds), and silicone oils (specific examples include dimethyl silicone oil). A silane coupling agent or a silazane compound is particularly preferable as the surface treatment agent. Examples of preferable silane coupling agents include silane compounds (specific examples include methyltrimethoxysilane and aminosilane). Examples of preferable silazane compounds include hexamethyldisilazane (HMDS). When a surface of a silica base (untreated silica particles) is treated with a surface treatment agent, a large number of hydroxyl groups (—OH) present on the surface of the silica base are partially or entirely substituted by functional groups derived from the surface treatment agent. As a result, silica particles having the functional groups derived from the surface treatment agent (specifically, functional groups that are more hydrophobic and/or more positively chargeable than the hydroxyl groups) on surfaces thereof are obtained.

EXAMPLES

The following describes examples of the present disclosure. Table 1 shows toners TA-1 to TA-7 and TB-1 to TB-13 (positively chargeable toners) according to the examples and comparative examples. Table 2 shows SAc resins A-1 to A-4 (styrene-acrylic acid-based resins) used in production of the toners shown in Table 1. Table 3 shows releasing agents B-1 to B-4 (ester waxes) used in production of the toners shown in Table 1.

TABLE 1

| Toner | Binder resin: Crystalline PES Amount [parts by mass] | SAc resin Type | SAc resin Amount [parts by mass] | Releasing agent Type | Releasing agent Amount [parts by mass] |
|---|---|---|---|---|---|
| TA-1 | 20 | A-2 | 50 | B-2 | 15 |
| TA-2 | 10 | A-1 | 30 | B-1 | 8 |
| TA-3 | 10 | A-1 | 30 | B-1 | 15 |
| TA-4 | 20 | A-2 | 50 | B-2 | 8 |
| TA-5 | 10 | A-1 | 50 | B-1 | 15 |
| TA-6 | 10 | A-2 | 50 | B-1 | 8 |
| TA-7 | 20 | A-1 | 30 | B-2 | 15 |
| TB-1 | 30 | A-1 | 50 | B-1 | 8 |
| TB-2 | 30 | A-2 | 50 | B-3 | 15 |
| TB-3 | 30 | A-2 | 50 | B-3 | 20 |
| TB-4 | 40 | A-2 | 50 | B-3 | 15 |
| TB-5 | 5 | A-2 | 50 | B-2 | 15 |
| TB-6 | 5 | A-2 | 50 | B-2 | 20 |
| TB-7 | 5 | A-2 | 50 | B-4 | 15 |
| TB-8 | 20 | A-3 | 50 | B-1 | 8 |
| TB-9 | 10 | A-3 | 50 | B-1 | 8 |
| TB-10 | 20 | A-4 | 50 | B-1 | 15 |
| TB-11 | 10 | A-4 | 50 | B-1 | 15 |
| TB-12 | 10 | A-3 | 30 | B-1 | 15 |
| TB-13 | 20 | A-4 | 30 | B-1 | 15 |

"Crystalline PES" in Table 1 represents a crystalline polyester resin. "SAc resin" in Tables 1 and 2 represents a crosslinked styrene-acrylic acid-based resin. "Amount" in Table 1 represents an amount (unit: parts by mass) of a corresponding material relative to 100 parts by mass of a non-crystalline polyester resin.

"A-1", "A-2", "A-3", and "A-4" in Table 1 represent the SAc resins A-1, A-2, A-3, and A-4 shown in Table 2, respectively. "B-1", "B-2", "B-3", and "B-4" in Table 1 represent the releasing agents B-1, B-2, B-3, and B-4 shown in Table 3, respectively.

TABLE 2

| SAc resin | Amino group ratio [%] |
|---|---|
| A-1 | 60 |
| A-2 | 40 |
| A-3 | 70 |
| A-4 | 30 |

TABLE 3

| Releasing agent | Melting point [° C.] |
|---|---|
| B-1 | 80 |
| B-2 | 60 |
| B-3 | 90 |
| B-4 | 50 |

The following describes production methods, evaluation methods, and evaluation results for the toners TA-1 to TA-7 and TB-1 to TB-13 in order. In evaluations in which errors may occur, an evaluation value was calculated by calculating an arithmetic mean of an appropriate number of measured values to ensure that any errors were sufficiently small.

[Preparation of Materials]

(Synthesis of Non-Crystalline Polyester Resin)

First, glycerin was prepared by hydrolyzing palm oil, which is a plant oil. Specifically, palm oil and an aqueous sodium hydroxide solution at a concentration of 10% by mass in an amount of twice as much as that necessary to completely saponify the palm oil were added into a reaction vessel. Then, the vessel contents were heated to completely saponify the palm oil (plant oil) at a temperature of 150° C. An aqueous glycerin solution was separated from the vessel contents after saponification and the obtained aqueous glycerin solution was distilled. Activated carbon treatment was performed on glycerin after distillation to purify glycerin.

Next, 200 g of ethylene glycol and 76 g of copper (II) nitrate trihydrate were added into a reaction vessel equipped with a reflux condenser. The vessel contents were then stirred for 2 hours while being heated at a temperature of 80° C. Thereafter, 52 g of tetraethoxysilane was dripped into the vessel and the vessel contents were stirred for 2 hours while being heated at the temperature of 80° C. Thereafter, 18 g of water was dripped into the vessel and the vessel contents were stirred for 3 hours at the temperature of 80° C. Through the above, a precipitate was yielded in the vessel. The yielded precipitate was dried at a temperature of 120° C. and then baked at a temperature of 400° C. in the air for 2 hours. Through the above, a copper/silica catalyst (copper content: 50% by mass) was obtained. An aqueous solution containing 29.8 mg of tetraammineplatinum (II) nitrate $[Pt(NH_3)_4(NO_3)_2]$ was added to 3 g of the obtained copper/silica catalyst and exsiccation was performed using a rotary evaporator. The resultant solid was dried at a temperature of 120° C. and then baked at a temperature of 400° C. in the air for 2 hours. Through the above, a copper-platinum/silica catalyst (mass ratio: Cu/Pt/Si=50/0.5/17) having a copper content of 50% by mass was obtained.

Subsequently, 2 g of the thus obtained copper-platinum/silica catalyst and 200 g of glycerin (purified glycerin) obtained as described above were added into a 500-mL iron autoclave equipped with a stirrer. The air within the autoclave was replaced by hydrogen. The internal temperature of the autoclave was then increased up to 230° C. and the material (liquid) within the autoclave was caused to react for 7 hours in a hydrogen ($H_2$) atmosphere under conditions of a pressure of 2 MPa and a temperature of 25° C. while hydrogen gas was introduced into the autoclave at a rate of 5 L/minute. Through the above, a reaction product (liquid) was yielded. The yielded reaction product was purified by a usual method to obtain plant-derived 1,2-propanediol.

A 5-L four-necked flask equipped with a stirrer ("SM-104" manufactured by AS ONE Corporation), a nitrogen inlet tube, a thermocouple, a dewatering conduit, and a rectification column was used as a reaction vessel. The reaction vessel was charged with 1,142 g of the plant-derived 1,2-propanediol (alcohol component) prepared as above, 1,743 g of a terephthalic acid (carboxylic acid component), and 4 g of tin (II) dioctanoate (condensation catalyst). The vessel contents were caused to react for 15 hours at a temperature of 230° C. in a nitrogen atmosphere at the atmospheric pressure while water generated through the reaction was removed. Thereafter, the internal pressure of the vessel was reduced to 8.3 kPa and the vessel contents were caused to react for additional 1 hour under conditions of the pressure of 8.3 kPa and the temperature of 230° C.

Subsequently, the internal pressure of the vessel was restored to the atmospheric pressure and the internal temperature of the vessel was reduced to 180° C. Then, 288 g of trimellitic anhydride was added into the vessel. Thereafter, the internal temperature of the vessel was increased up to 210° C. at a rate of 10° C./hour. Subsequently, the vessel contents were caused to react for additional 10 hours at the atmospheric pressure and the temperature of 210° C. The internal pressure of the vessel was then reduced to 20 kPa and the vessel contents were caused to react for additional 1 hour at the pressure of 20 kPa and a temperature of 230° C.

After completion of the reaction, the vessel contents were taken out of the vessel and cooled. Through the above, a non-crystalline polyester resin having a softening point (Tm) of 142° C., a melting point (Mp) of 65° C., and a crystallinity index (=Tm/Mp) of 2.2 was obtained.

(Synthesis of Crystalline Polyester Resin)

A 5-L four-necked flask equipped with a thermometer (thermocouple), a dewatering conduit, a nitrogen inlet tube, and a stirrer was charged with 990 g of 1,4-butanediol (alcohol component), 242 g of 1,6-hexanediol (alcohol component), 1,480 g of a fumaric acid (acid component), and 2.5 g of 1,4-benzenediol. The flask contents were caused to react for 5 hours at a temperature of 170° C. Subsequently, the flask contents were caused to react for 1.5 hours at a temperature of 210° C. Subsequently, the flask contents were caused to react for 1 hour in a depressurized atmosphere (pressure: 8 kPa) at the temperature of 210° C. The atmosphere within the flask was then restored to a normal pressure and 69 g of styrene (styrene-acrylic acid-based component) and 54 g of n-butyl methacrylate (styrene-acrylic acid-based component) were added into the flask. The flask contents were then caused to react for 1.5 hours at the temperature of 210° C. The flask contents were then caused to react for 1 hour in a depressurized atmosphere (pressure: 8 kPa) at the temperature of 210° C. Through the above, a crystalline polyester resin was obtained. The obtained crystalline polyester resin had a softening point (Tm) of 88.8° C., a melting point (Mp) of 82.0° C., a crystallinity index (=Tm/Mp) of 1.08, an acid value of 3.1 mgKOH/g, a hydroxyl value of 19 mgKOH/g, Mw of 27,500, and Mn of 3,620.

(Synthesis of SAc Resins A-1 to A-4)

A reaction vessel equipped with a stirrer and a thermometer was charged with 5,058 g of ion exchanged water, 22 g of a dispersant, 14 g of sodium sulfate, and 60 g of a defoaming agent (polyoxyalkylene pentaerythritol ether: "DISFOAM (registered Japanese trademark) CE-457" manufactured by NOF Corporation). Subsequently, 6,740 g of aminoethyl acrylate, 2.136 g of styrene, 10 g of a cross-linking agent (divinylbenzene having purity of 56.5%), 75 g of a polymerization initiator (BPO: benzoyl peroxide), and 14 g of t-butylperoxy-2-ethylhexyl monocarbonate ("TRIGONOX (registered Japanese trademark) 117" manufactured by Kayaku Akzo Corporation) were added into the reaction vessel. The temperature of the vessel contents was 40° C. Subsequently, the temperature of the vessel contents was increased from 40° C. to 130° C. over 65 minutes while the vessel contents were stirred. Once the temperature of the vessel contents reached 130° C., reaction (specifically, polymerization reaction) of the vessel contents was caused for additional 2 hours. Thereafter, the vessel contents were cooled. Through the above, a dispersion of a crosslinked styrene-acrylic acid-based resin was obtained. The obtained dispersion was filtered (solid-liquid separation) using a metal mesh having a pore size of 2 mm to collect resin particles (powder). Fine powder was then removed from the obtained resin particles (powder) using nylon filter cloth. Thereafter, washing and drying were performed. Through the above, the SAc resin A-1 (specifically, a crosslinked styrene-acrylic acid-based resin) was obtained. Each of the SAc resins A-2 to A-4 (crosslinked styrene-acrylic acid-based resins) was obtained by changing the monomer blend ratio (aminoethyl acrylate/styrene) in the above method for synthesizing the Sac resin A1 such that the amino group ratio indicated in Table 2 was attained.

Results of measurement of the amino group ratio for the SAc resins A-1 to A-4 (crosslinked styrene-acrylic acid-based resins) obtained as above were as indicated in Table 2. For example, the amino group ratio in the SAc resin A-1 was 60%. The amino group ratio was measured by the following method.

<Method for Measuring Amino Group Ratio>

A Fourier transform infrared spectrometer (FT-IR spectrometer, "Frontier" manufactured by PerkinElmer Inc.) was used as a measuring device. A measurement mode adopted was an attenuated total reflection (ATR) mode. Diamond (refractive index: 2.4) was used as an ATR crystal.

The ATR crystal was set in the measuring device, and 1 mg of a sample (measurement target: any of the SAc resins A-1 to A-4) was put on the ATR crystal. Subsequently, pressure at a load of at least 60 N and no greater than 80 N was applied to the sample using a pressure arm of the measuring device. Next, an FT-IR spectrum of the sample was plotted under a condition of an infrared incident angle of 45. An intensity of a peak derived from an aromatic ring and an intensity of a peak derived from an amino group were determined from the plotted FT-IR spectrum. Then, the amino group ratio (ratio of the intensity of the peak derived from the amino group to the intensity of the peak derived from the aromatic ring) was calculated.

(Preparation of Releasing Agents B-1 to B-4)

A flask equipped with a stirrer, a cooling tube, a thermometer, and a nitrogen inlet tube was charged with 100 g (0.734 mol) of pentaerythritol and 900 g (3.155 mol) of a stearic acid. Nitrogen gas was then introduced into the flask through the nitrogen inlet tube and the flask contents were caused to react for 15 hours under conditions of a normal pressure (atmospheric pressure) and a temperature of 220° C. while by-product water generated through the reaction was evaporated. Through the above, an ester compound having an acid value of 12.1 mgKOH/g was obtained. Subsequently, the following deacidification treatment was performed on the obtained ester compound.

First, 300 g of xylene and 86 g of ethanol were added into a flask containing 845.2 g of the ester compound obtained as above. Further, an aqueous potassium hydroxide solution at a concentration of 10% by mass containing potassium hydroxide in an amount equivalent to 1.5 times the acid value of the ester compound was added into the flask. Subsequently, the flask contents were stirred for 30 minutes at a temperature of 75° C. The flask contents were then left to stand for 30 minutes and thereafter a water layer of the flask contents was removed. An oil layer of the flask contents including the ester compound was left within the flask.

Through the above, the ester compound was deacidified. Thereafter, 169 g of ion exchanged water was added into the flask. The flask contents were then stirred for 30 minutes at a temperature of 70° C. Subsequently, the flask contents were left to stand for 30 minutes and then a water layer of the flask contents was removed. An oil layer of the flask contents was left within the flask. The flask contents were then washed with water until the pH of a water layer became neutral. Specifically, ion exchanged water was added into the flask to wash the flask contents. Thereafter, a water layer of the flask contents was taken out of the flask through liquid-liquid extraction and filtration and the pH of the water layer was determined. If the pH of the water layer was not neutral, liquid-liquid extraction and filtration were performed after washing the flask contents with water again.

Washing with water, liquid-liquid extraction, and filtration were repeated until pH of the water layer became neutral. In preparation of the releasing agent B-1, the pH of the water layer became neutral after washing with water, liquid-liquid extraction, and filtration were repeated four times.

Subsequently, a solvent within the flask was evaporated in a depressurized atmosphere (pressure: 1 kPa) at a temperature of 180° C. and then the flask contents were filtered (solid-liquid separation). A solid obtained through the filtration was the releasing agent B-1 (specifically, a synthetic ester wax) having a melting point of 80° C.

Note that each of the releasing agents B-2 to B-4 was prepared in the same manner as the releasing agent B-1 in all aspects other than that composition (specifically, type and amount) of a carboxylic acid component and an alcohol component was changed such that the releasing agent has a melting point indicated in Table 3. In preparation of for example the releasing agent B-1, 900 g of a stearic acid was used as the carboxylic acid component and 100 g of pentaerythritol was used as the alcohol component. The releasing agent B-2 (specifically, a synthetic ester wax) having a melting point of 60° C., the releasing agent B-3 (specifically, a synthetic ester wax) having a melting point of 90° C., and the releasing agent B-4 (specifically, a synthetic ester wax) having a melting point 50° C. were each obtained as described above.

[Method for Producing Toner]

(Preparation of Toner Mother Particles)

First, 100 parts by mass of the non-crystalline polyester resin (the non-crystalline polyester resin obtained as described above), the crystalline polyester resin (the crystalline polyester resin obtained as described above) in an amount indicated in Table 1, a crosslinked styrene-acrylic acid-based resin (any of the SAc resins A-1 to A-4 specified for each toner) in an amount indicated in Table 1, an ester wax (any of the releasing agents B-1 to B-4 specified for each toner) in an amount indicated in Table 1, 5 parts by mass of carbon black ("MA-100" manufactured by Mitsubishi Chemical Corporation), and 1 part by mass of a quaternary ammonium salt ("BONTRON (registered Japanese trademark) P-51" manufactured by ORIENT CHEMICAL INDUSTRIES, Co., Ltd.) were mixed using an FM mixer ("FM-20B" manufactured by Nippon Coke & Engineering Co., Ltd.). For example, in production of the toner TA-1, 100 parts by mass of the above-described non-crystalline polyester resin, 20 parts by mass of the above-described crystalline polyester resin, 50 parts by mass of the crosslinked styrene-acrylic acid-based resin (the SAc resin A-2), 15 parts by mass of the ester wax (the releasing agent B-2), 5 parts by mass of the carbon black (MA-100), and 1 part by mass of the quaternary ammonium salt (BONTRON P-51) were mixed.

Subsequently, the resultant mixture was melt-kneaded using a twin-screw extruder ("PCM-30" manufactured by Ikegai Corp). Thereafter, the resultant kneaded product was cooled.

The cooled kneaded product was then coarsely pulverized using a pulverizer ("ROTOPLEX (registered Japanese trademark)" manufactured by Hosokawa Micron Corporation). The resultant coarsely pulverized product was then finely pulverized using a pulverizer ("Turbo Mill Type RS" manufactured by FREUND-TURBO CORPORATION). The resultant finely pulverized product was then classified using a classifier ("Elbow Jet Type EJ-LABO" manufactured by Nittetsu Mining Co., Ltd.). Through the above, toner mother particles having a volume median diameter ($D_{50}$) of 7 μm were obtained.

(External Addition Process)

First, 100 parts by mass of the toner mother particles, 1.2 parts by mass of hydrophobic silica fine particles ("AEROSIL (registered Japanese trademark) RA-200H" manufactured by Nippon Aerosil Co., Ltd., content: dry silica particles surface modified with trimethylsilyl group and amino group, number average primary particle diameter: approximately 12 nm), and 0.8 parts by mass of conductive titanium oxide fine particles ("EC-100" manufactured by Titan Kogyo, Ltd., base: $TiO_2$ particles, coat layer: Sb-doped $SnO_2$ film, volume median diameter ($D_{50}$): approximately 0.35 μm) were mixed for 2 minutes using an FM mixer ("FM-10B" manufactured by Nippon Coke & Engineering Co., Ltd.) under conditions of a rotational speed of 3,000 rpm and a jacket temperature of 20° C. Through the above, external additives (the silica particles and the titanium oxide particles) adhered to surfaces of the toner mother particles. Thereafter, sifting was performed using a 300-mesh sieve (pore size: 48 μm). Each of the toners (the toners TA-1 to TA-7 and TB-1 to TB-13) including a large number of toner particles was obtained as above.

Table 4 indicates results of measurement of a dispersion diameter of the releasing agent (ester wax) in the toner particles and a storage elastic modulus $G'_{90}$ (specifically, a storage elastic modulus of the toner at a temperature of 90° C.) for each of the toners TA-1 to TA-7 and TB-1 to TB-13 obtained as above.

TABLE 4

| Toner | Dispersion diameter of releasing agent [nm] | $G'_{90}$ [Pa] |
|---|---|---|
| TA-1 | 630 | $1.14 \times 10^5$ |
| TA-2 | 890 | $4.24 \times 10^5$ |
| TA-3 | 940 | $4.81 \times 10^5$ |
| TA-4 | 550 | $1.28 \times 10^5$ |
| TA-5 | 830 | $4.41 \times 10^5$ |
| TA-6 | 510 | $4.78 \times 10^5$ |
| TA-7 | 960 | $1.34 \times 10^5$ |
| TB-1 | 1460 | $2.31 \times 10^5$ |
| TB-2 | 910 | $8.16 \times 10^4$ |
| TB-3 | 1240 | $2.31 \times 10^5$ |
| TB-4 | 1890 | $7.01 \times 10^4$ |
| TB-5 | 710 | $6.21 \times 10^3$ |
| TB-6 | 2080 | $6.11 \times 10^3$ |
| TB-7 | 840 | $4.28 \times 10^3$ |
| TB-8 | 1240 | $3.77 \times 10^3$ |
| TB-9 | 1120 | $2.86 \times 10^3$ |
| TB-10 | 380 | $3.76 \times 10^3$ |
| TB-11 | 410 | $3.48 \times 10^3$ |
| TB-12 | 1070 | $4.68 \times 10^3$ |
| TB-13 | 400 | $2.48 \times 10^3$ |

As for the toner TA-1 for example, the dispersion diameter of the releasing agent was 630 nm and the storage elastic modulus $G'_{90}$ was $1.14 \times 10^5$ Pa. These properties were measured by the respective following methods.

<Method for Measuring Dispersion Diameter of Releasing Agent>

A toner (measurement target: any of the toners TA-1 to TA-7 and TB-1 to TB-13) was dispersed in a cold-setting epoxy resin and the cold-setting epoxy resin was hardened in an atmosphere at a temperature of 40° C. for 2 days to obtain a hardened material. The obtained hardened material was dyed with osmium tetroxide and then sliced using an ultramicrotome ("EM UC6" manufactured by Leica Microsystems) equipped with a diamond knife to obtain a thin sample piece having a thickness of 250 μm. A cross section of the obtained thin sample piece (particularly, cross sections of toner mother particles) was then captured using a scanning electron microscope ("JSM-7401F" manufactured by JEOL Ltd., type: FE-SEM, FE electron source: conical FE electron gun). A captured SEM image (cross-sectional image of toner particles) was analyzed using image analysis software ("WinROOF" manufactured by Mitani Corporation) to measure a dispersion diameter (equivalent circle diameter) of the releasing agent (ester wax).

A number average dispersion diameter of releasing agent domains (ester wax domains) was measured in a cross section of a toner particle. Specifically, dispersion diameters of 100 releasing agent domains were measured in a cross-sectional image of a toner particle, and a number average dispersion diameter of releasing agent domains in a cross section of the toner particle was calculated based on the measured dispersion diameters of the 100 releasing agent domains. In a like manner, a number average dispersion diameter of releasing agent domains in a cross section of each of 100 toner particles included in the toner was obtained, and an arithmetic mean of the thus obtained 100 values for the number average dispersion diameter was determined to be an evaluation value (dispersion diameter of the releasing agent) for the toner.

<Method for Measuring Storage Elastic Modulus $G'_{90}$>

First, 0.1 g of a toner (measurement target: any of the toners TA-1 to TA-7 and TB-1 to TB-13) was set in a pelleting machine and a load of 20 kN was applied to the toner at normal temperature (approximately 25° C.) for 2 minutes, whereby a cylindrical pellet having a diameter of 10 mm and a thickness of 1 mm was obtained. The obtained pellet was then set in a measuring device. The measuring device used was a rheometer ("ARES" manufactured by TA Instruments Japan Inc.). A measurement jig (circular parallel plate having a diameter of 10 mm) was attached to a tip end of a shaft of the measuring device (specifically, a shaft driven by a motor). A G' temperature dependence curve (vertical axis: storage elastic modulus, horizontal axis: temperature) of the toner was then obtained through measurement performed under the following conditions.

(Measurement Conditions)

Measurement temperature range: 50° C. to 200° C.

Heating rate: 2° C./minute

Frequency: 6.28 radian/second

Measurement intervals: 15 seconds

Applied strain: automatic measurement mode (default value: 0.1%)

Elongation correction: automatic measurement mode

A storage elastic modulus $G'_{90}$ (specifically, a storage elastic modulus of the toner at a temperature of 90° C.) was read from the storage elastic modulus temperature dependence curve obtained as above.

[Evaluation Methods]

Each sample (each of the toners TA-1 to TA-7 and TB-1 to TB-13) was evaluated by the following methods.

(Heat-Resistant Preservability)

First, 2 g of a toner (evaluation target: any of the toners TA-1 to TA-7 and TB-1 to TB-13) was put into a 20-mL polyethylene vessel and the vessel was left to stand for 3 hours in a thermostatic chamber set at 50° C. Thereafter, the toner was taken out of the thermostatic chamber and cooled to room temperature (approximately 25° C.), whereby an evaluation toner was obtained.

Subsequently, the obtained evaluation toner was placed on a 140-mesh sieve (pore size: 105 μm) of a known mass. A total mass of the sieve and the evaluation toner placed thereon was measured to determine a mass of the toner on the sieve (i.e., a mass of the toner before sifting). The sieve was then set in a powder property evaluation machine ("POWDER TESTER (registered Japanese trademark)" manufactured by Hosokawa Micron Corporation), and the evaluation toner was sifted by shaking the sieve for 30 seconds at a rheostat level of 5 in accordance with a manual of POWDER TESTER. After the sifting, a mass of toner remaining on the sieve without passing therethrough (i.e., a mass of the toner after sifting) was measured. A toner aggregation rate (unit: % by mass) was calculated by the following equation based on the mass of the toner before sifting and the mass of the toner after sifting.

$$\text{Toner aggregation rate} = 100 \times (\text{mass of toner after sifting})/(\text{mass of toner before sifting})$$

A toner aggregation rate of no greater than 20% by mass was evaluated as "good" and a toner aggregation rate of greater than 20% by mass was evaluated as "poor".

(Fixability: Low-Temperature Fixability and Hot Offset Resistance)

A two-component developer was prepared by mixing 100 parts by mass of a developer carrier (a carrier for FS-C5200DN) and 5 parts by mass of a toner (evaluation target: any of the toners TA-1 to TA-7 and TB-1 to TB-13) for 30 minutes using a ball mill.

A printer ("FS-C5200DN" manufactured by KYOCERA Document Solutions Inc., modified so as to be capable of changing a fixing temperature) including a roller-roller type heat and pressure fixing device was used as an evaluation apparatus. The two-component developer prepared as above was loaded into a developing device of the evaluation apparatus and a toner for replenishment use (evaluation target: any of the toners TA-1 to TA-7 and TB-1 to TB-13) was loaded into a toner container of the evaluation apparatus.

A black solid image (specifically, an unfixed toner image) having a size of 25 mm×25 mm was formed on evaluation paper ("COLORCOPY (registered Japanese trademark)" manufactured by Mondi, A4 size, basis weight: 90 g/m$^2$) using the evaluation apparatus under conditions of a linear velocity of 105 mm/second and a toner application amount of 1.3 mg/cm$^2$ in an environment at a temperature of 23° C. and a relative humidity of 50%. The paper with the image formed thereon was then passed through the fixing device of the evaluation apparatus.

In evaluation of lowest fixing temperature, the fixing temperature was set in a range of from 100° C. to 140° C. Specifically, the fixing temperature of the fixing device was decreased from 140° C. in increments of 2° C. and whether or not the toner could be fixed to the paper at each fixing temperature was determined. Thus, a lowest temperature (lowest fixing temperature) at which the solid image (toner image) could be fixed to the paper was measured. Whether or not the toner could be fixed was determined by the following fold-rubbing test. Specifically, the evaluation paper passed through the fixing device was folded in half such that a surface on which the image had been formed was folded inwards, and a 1-kg brass weight covered with cloth was rubbed back and forth five times on the image on the fold. The paper was then opened to observe a folded part of the paper (a part on which the solid image had been formed). A length of peeling of the toner (peeling length) in the folded part was measured. A lowest temperature among fixing temperatures for which the peeling length was no longer than 1 mm was determined as the lowest fixing temperature. A lowest fixing temperature of equal to or lower than 130°

C. was evaluated as "good" and a lowest fixing temperature of higher than 130° C. was evaluated as "poor".

Also, a highest fixing temperature was measured within a fixing temperature range of from 150° C. to 230° C. Specifically, the fixing temperature of the fixing device was increased from 150° C. in increments of 2° C. and whether or not offset occurred was determined for each fixing temperature. Thus, a highest temperature (highest fixing temperature) at which offset did not occur was measured. Whether or not offset occurred was determined by visually observing the evaluation paper passed through the fixing device. Specifically, when stain formed on the evaluation paper by toner adhesion to a fixing roller was observed, it was determined that offset occurred. A highest fixing temperature of equal to or higher than 200° C. was evaluated as "good" and a highest fixing temperature of lower than 200° C. was evaluated as "poor".

(Gloss)

A two-component developer was prepared using a toner (evaluation target: any of the toners TA-1 to TA-7 and TB-1 to TB-13) in the same manner as that employed in the above-described evaluation of fixability. The prepared two-component developer and a toner for replenishment use (evaluation target: any of the toners TA-1 to TA-7 and TB-1 to TB-13) were loaded in an evaluation apparatus ("FS-C5200DN" manufactured by KYOCERA Document Solutions Inc., modified so as to be capable of changing a fixing temperature). Subsequently, a solid image was formed on evaluation paper using the evaluation apparatus in an environment at a temperature of 23° C. and a relative humidity of 50% under the same conditions as those employed in the above-described evaluation of fixability, and the toner was fixed to the paper by passing the paper through a fixing device of the evaluation apparatus. The fixing temperature was changed within a range of from 130° C. to 170° C. Specifically, the fixing temperature was changed at every formation of an image to obtain respective images formed at a fixing temperature of 130° C., 150° C., and 170° C. For each of the images formed at a fixing temperature of 130° C., 150° C., and 170° C., a gloss value of the image after fixing was measured at a measurement angle of 60° using a handheld gloss checker ("Gloss Checker IG-331" manufactured by HORIBA, Ltd.). When the gloss value was at least 15 for each of the images formed at a fixing temperature of 130° C., 150° C., and 170° C., gloss was evaluated as "good". When the gloss value was smaller than 15 for any of the images formed at a fixing temperature of 130° C., 150° C., and 170° C. gloss was evaluated as "poor". Table 5 shows a highest gloss value among gloss values for the three images formed at a fixing temperature at 130° C., 150° C., and 170° C.

[Evaluation Results]

Table 5 shows evaluation results for each sample (each of the toners TA-1 to TA-7 and TB-1 to TB-13). In Table 5, "L-fixing" represents low-temperature fixability, "Preservability" represents heat-resistant preservability, and "H.O." represents hot offset resistance. Table 5 shows the lowest fixing temperature as an evaluation result of low-temperature fixability, the toner aggregation rate as an evaluation result of heat-resistant preservability, the highest fixing temperature as an evaluation result of hot offset resistance, and the gloss value (highest value) as an evaluation result of gloss.

TABLE 5

| | Toner | L-fixing [° C.] | H.O. [° C.] | Preservability [% by mass] | Gloss |
|---|---|---|---|---|---|
| Example 1 | TA-1 | 116 | 208 | 12 | 19 |
| Example 2 | TA-2 | 128 | 228 | 10 | 16 |
| Example 3 | TA-3 | 126 | 230 | 6 | 18 |
| Example 4 | TA-4 | 120 | 202 | 16 | 17 |
| Example 5 | TA-5 | 120 | 230 | 15 | 19 |
| Example 6 | TA-6 | 128 | 224 | 6 | 16 |
| Example 7 | TA-7 | 118 | 230 | 8 | 17 |
| Comparative example 1 | TB-1 | 138 | 208 | 49 | 17 |
| Comparative example 2 | TB-2 | 124 | 214 | 18 | 12 |
| Comparative example 3 | TB-3 | 140 | 206 | 33 | 19 |
| Comparative example 4 | TB-4 | 136 | 178 | 32 | 15 |
| Comparative example 5 | TB-5 | 140 | 222 | 7 | 13 |
| Comparative example 6 | TB-6 | 132 | 230 | 44 | 16 |
| Comparative example 7 | TB-7 | 132 | 202 | 38 | 15 |
| Comparative example 8 | TB-8 | 126 | 212 | 60 | 17 |
| Comparative example 9 | TB-9 | 130 | 222 | 52 | 17 |
| Comparative example 10 | TB-10 | 126 | 188 | 11 | 12 |
| Comparative example 11 | TB-11 | 128 | 192 | 7 | 13 |
| Comparative example 12 | TB-12 | 138 | 206 | 33 | 15 |
| Comparative example 13 | TB-13 | 118 | 196 | 14 | 10 |

The toners TA-1 to TA-7 (toners according to Examples 1 to 7) each had the above-described basic features. Specifically, the toner particles of each of the toners TA-1 to TA-7 contained a non-crystalline polyester resin and an ester wax. The ester wax had a melting point of at least 60° C. and no higher than 80° C. (see Tables 1 and 3). The toner particles further contained a crystalline polyester resin and a styrene-acrylic acid-based resin (see Table 1). The crystalline polyester resin had the first repeating unit derived from an acrylic acid-based monomer and the second repeating unit derived from a styrene-based monomer (see "Synthesis of Crystalline Polyester Resin" described above). The styrene-acrylic acid-based resin had the third repeating unit derived from an acrylic acid-based monomer having an amino group and the fourth repeating unit derived from a styrene-based monomer. The amino group ratio in the styrene-acrylic acid-based resin (i.e., a ratio of an intensity of a peak derived from an amino group included in the third repeating unit to an intensity of a peak derived from an aromatic ring included in the fourth repeating unit as determined from an FT-IR spectrum of the styrene-acrylic acid-based resin measured by the ATR method) was at least 40% and no greater than 60% (see Tables 1 and 2). The toner had a storage elastic modulus $G'_{90}$ (specifically, a storage elastic modulus of the toner at a temperature of 90°) of at least $1.00\times10^5$ Pa and no greater than $5.00\times10^5$ Pa (see Table 4). A dispersion diameter of the ester wax (releasing agent) in the toner particles was at least 500 nm and no greater than 1,000 nm (see Table 4).

As shown in Table 5, the toners TA-1 to TA-7 were excellent in heat-resistant preservability, low-temperature fixability, and hot offset resistance. Further, an image having excellent gloss could be formed through use of each of the toners TA-1 to TA-7.

The toner TB-1 (toner according to Comparative example 1) was inferior to the toners TA-1 to TA-7 in evaluation of low-temperature fixability and heat-resistant preservability. It is considered that the dispersion diameter of the releasing agent became excessively large since shearing stress in kneading of toner components (binder resin and internal additives) was insufficient due to an excessively large amount of the crystalline polyester resin.

The toner TB-2 (toner according to Comparative example 2) was inferior to the toners TA-1 to TA-7 in evaluation of gloss. It is considered that the bleed out amount of the releasing agent (ester wax) was insufficient due to an excessively high melting point of the releasing agent.

The toner TB-3 (toner according to Comparative example 3) was inferior to the toners TA-1 to TA-7 in evaluation of low-temperature fixability and heat-resistant preservability. The bleed out amount of the releasing agent (ester wax) in the toner TB-3 increased as a result of the amount of the releasing agent being increased in the toner TB-3 as compared with that in the toner TB-2. However, it is considered that the dispersion diameter of the releasing agent became excessively large since dispersibility of toner components (internal additives) was impaired due to an excessively large amount of the releasing agent.

The toner TB-4 (toner according to Comparative example 4) was inferior to the toners TA-1 to TA-7 in evaluation of low-temperature fixability, heat-resistant preservability, and hot offset resistance. The bleed out amount of the releasing agent (ester wax) in the toner TB-4 increased as a result of the amount of the crystalline polyester resin being increased in the toner TB-4 as compared with that in the toner TB-2. However, it is considered that the dispersion diameter of the releasing agent became excessively large since shearing stress in kneading of toner components (binder resin and internal additives) was insufficient due to an excessively large amount of the crystalline polyester resin.

The toner TB-5 (toner according to Comparative example 5) was inferior to the toners TA-1 to TA-7 in evaluation of low-temperature fixability and gloss. It is considered that sharp meltability of the toner TB-5 was insufficient due to an excessively small amount of the crystalline polyester resin. Also, it is considered that the bleed out amount of the releasing agent (ester wax) was insufficient due to an excessively low storage elastic modulus $G'_{90}$ of the toner TB-5.

The toner TB-6 (toner according to Comparative example 6) was inferior to the toners TA-1 to TA-7 in evaluation of low-temperature fixability and heat-resistant preservability. The bleed out amount of the releasing agent (ester wax) in the toner TB-6 increased as a result of the amount of the releasing agent being increased in the toner TB-6 as compared with that in the toner TB-5. However, it is considered that the dispersion diameter of the releasing agent became excessively large since dispersibility of toner components (internal additives) was impaired due to an excessively large amount of the releasing agent.

The toner TB-7 (toner according to Comparative example 7) was inferior to the toners TA-1 to TA-7 in evaluation of low-temperature fixability and heat-resistant preservability. The bleed out amount of the releasing agent (ester wax) in the toner TB-7 increased as a result of the releasing agent in the toner TB-7 having a melting point lower than that of the releasing agent in the toner TB-5. However, heat-resistant preservability of the toner TB-7 was impaired due to a low melting point of the releasing agent.

Each of the toners TB-8, TB-9, and TB-12 (toners according to Comparative examples 8, 9, and 12) was inferior to the toners TA-1 to TA-7 in evaluation of heat-resistant preservability. It is considered that the dispersion diameter of the releasing agent became excessively large since compatibility between the binder resin and the ester wax (releasing agent) was insufficient due to a high amino group ratio in the styrene-acrylic acid-based resin.

Each of the toners TB-10, TB-11, and TB-13 (toners according to Comparative examples 10, 11, and 13) was inferior to the toners TA-1 to TA-7 in evaluation of hot offset resistance. It is considered that the binder resin and the ester wax (releasing agent) were excessively compatible with each other (consequently, the dispersion diameter of the releasing agent became excessively small) due to a low amino group ratio in the styrene-acrylic acid-based resin.

What is claimed is:

1. An electrostatic latent image developing toner comprising a plurality of toner particles containing a non-crystalline polyester resin and an ester wax, wherein:

the toner particles further contain a crystalline polyester resin and a specific resin, the crystalline polyester resin has a first repeating unit derived from a (meth)acrylic acid alkyl ester and a second repeating unit derived from a styrene, the specific resin has a third repeating unit derived from a (meth)acrylic acid amino alkyl ester and a fourth repeating unit derived from styrene, in an FT-IR spectrum of the specific resin measured by an ATR method, an intensity of a peak derived from an amino group included in the third repeating unit is at least 40% and no greater than 60% of an intensity of a peak derived from an aromatic ring included in the fourth repeating unit, the toner has a storage elastic modulus of at least $1.00\times10^5$ Pa and no greater than $5.00\times10^5$ Pa at a temperature of 90° C., the ester wax has a melting point of at least 60° C. and no higher than 80° C., and a dispersion diameter of the ester wax in the toner particles is at least 500 nm and no greater than 1,000 nm.

2. The electrostatic latent image developing toner according to claim 1, wherein an amount of the crystalline polyester resin contained in the toner particles is at least 10 parts by mass and no greater than 20 parts by mass relative to 100 parts by mass of the non-crystalline polyester resin, an amount of the specific resin contained in the toner particles is at least 30 parts by mass and no greater than 50 parts by mass relative to 100 parts by mass of the non-crystalline polyester resin, and an amount of the ester wax contained in the toner particles is at least 8 parts by mass and no greater than 15 parts by mass relative to 100 parts by mass of the non-crystalline polyester resin.

3. The electrostatic latent image developing toner according to claim 2, wherein the non-crystalline polyester resin has a repeating unit derived from an aliphatic diol having a carbon number of at least 2 and no greater than 6 and does not have a repeating unit derived from a bisphenol.

4. The electrostatic latent image developing toner according to claim 2, wherein:

the non-crystalline polyester resin is a polymer of monomers including 1,2-propanediol, an aromatic dicarboxylic acid, and a tribasic carboxylic acid, the crystalline polyester resin is a polymer of monomers including an α,ω-alkanediol, a dibasic carboxylic acid, a styrene, and a (meth)acrylic acid alkyl ester, and the specific resin is a polymer of monomers including a styrene, a (meth)acrylic acid amino alkyl ester, and a cross-linking agent.

5. The electrostatic latent image developing toner according to claim 4, wherein the non-crystalline polyester resin is a polymer of monomers including 1,2-propanediol, a terephthalic acid, and a trimellitic acid.

6. The electrostatic latent image developing toner according to claim 4, wherein the crystalline polyester resin is a polymer of monomers including a fumaric acid, styrene, n-butyl methacrylate, and at least one of 1,4-butanediol and 1,6-hexanediol.

7. The electrostatic latent image developing toner according to claim 4, wherein the specific resin is a polymer of monomers including styrene, aminoethyl acrylate, and divinylbenzene.

8. The electrostatic latent image developing toner according to claim 1, which is a pulverized toner.

9. The electrostatic latent image developing toner according to claim 1, which is a positively chargeable toner.

* * * * *